United States Patent [19]

Abbey

[11] 4,387,685

[45] Jun. 14, 1983

[54] FLUIDIC CONTROL SYSTEM INCLUDING VARIABLE VENTURI

[76] Inventor: Harold G. Abbey, 11 Goldsmith Dr., Holmdel, N.J. 07733

[21] Appl. No.: 307,956

[22] Filed: Oct. 2, 1981

Related U.S. Application Data

[63] Continuation-in-part of Ser. No. 214,626, Dec. 10, 1980, Pat. No. 4,308,835.

[51] Int. Cl.[3] ..... F02M 9/14

[52] U.S. Cl. ..... 123/439; 123/440; 73/861.53; 73/861.63; 261/DIG. 56; 261/23 A; 261/53; 261/44 D

[58] Field of Search ..... 261/DIG. 56, 53, 23 A, 261/44 D; 123/440, 439; 73/861.53, 861.63, 861.64, 861.71

[56] References Cited

U.S. PATENT DOCUMENTS

| | | | |
|---|---|---|---|
| 1,063,866 | 6/1913 | Filson | 261/DIG. 56 |
| 1,183,137 | 5/1916 | Swarts | 261/53 |
| 1,457,408 | 6/1923 | Sunderman | 261/53 |
| 1,776,192 | 9/1930 | Perry | 261/53 |
| 1,983,255 | 12/1934 | Wahlmark | 261/DIG. 56 |
| 2,007,337 | 7/1935 | Mallory | 261/53 |
| 2,333,030 | 10/1943 | Meyer | 261/53 |
| 3,069,146 | 12/1962 | MacNeill | 261/53 |
| 3,398,937 | 8/1968 | Stoltman | 261/50 A |
| 3,802,671 | 4/1974 | Klutho | 261/DIG. 56 |
| 4,110,416 | 8/1978 | Sarto | 261/DIG. 56 |

FOREIGN PATENT DOCUMENTS

| | | | |
|---|---|---|---|
| 2014140 | 10/1970 | Fed. Rep. of Germany | 261/DIG. 56 |
| 30791 | 3/1905 | Switzerland | 261/DIG. 56 |

OTHER PUBLICATIONS

Passini; Weber Carburetors; Speedsport Motorbooks; Brentford, Middlesex England; Apr. 1973, pp. 1–13.

*Primary Examiner*—Tim R. Miles
*Attorney, Agent, or Firm*—Michael Ebert

[57] ABSTRACT

A fluidic control system provided with a variable Venturi structure whose movable element is automatically shifted as a function of the mass-volume of fluids passing through the structure to produce an output which depends on the adjusted position of the element or the resultant velocity-pressure. The system is applicable to the metering, proportioning and blending of fluids. In the context of an internal combustion automotive engine in which the variable Venturi structure acts to intermingle combustion air and fuel prior to ignition, the system provides a stoichiometric or other ratio of air-to-fuel that represents the optimum value for the prevailing condition of engine speed and load throughout a broad operating range, thereby effecting a marked improvement in fuel economy and reducing the emission of pollutants.

15 Claims, 14 Drawing Figures

AIR FLOW

T1
P1
17
16B
26
25
22
20
21
SP
15
PP
P2
T2
13
18
23
24
27
16
TP
16a
16b
14
10
19
12
11

18
19
17
14
12
16
26
15
28
AIR SUPPLY
INPUT MANIFOLD
10
P1
P4
P2
P3
30'
31
34
P4
32
29
30
FUEL TANK
VACUUM AMPLIFIER
33
TR
35
ACCUMULATOR

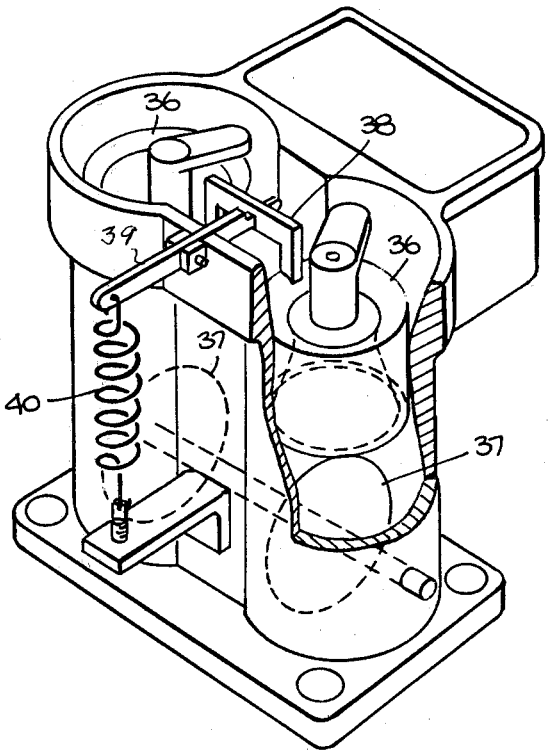
Fig. 5.
Fig. 13.
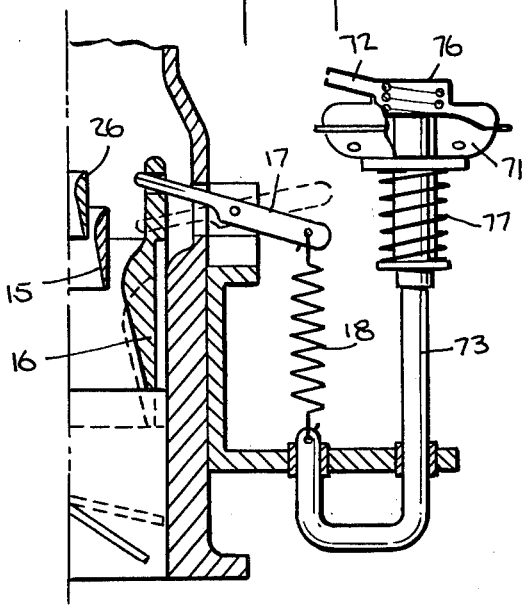
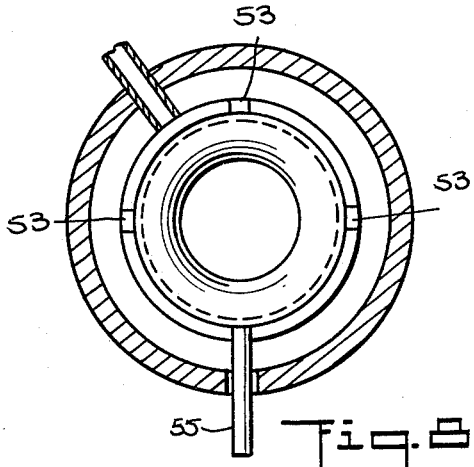
Fig. 8.
Fig. 7.
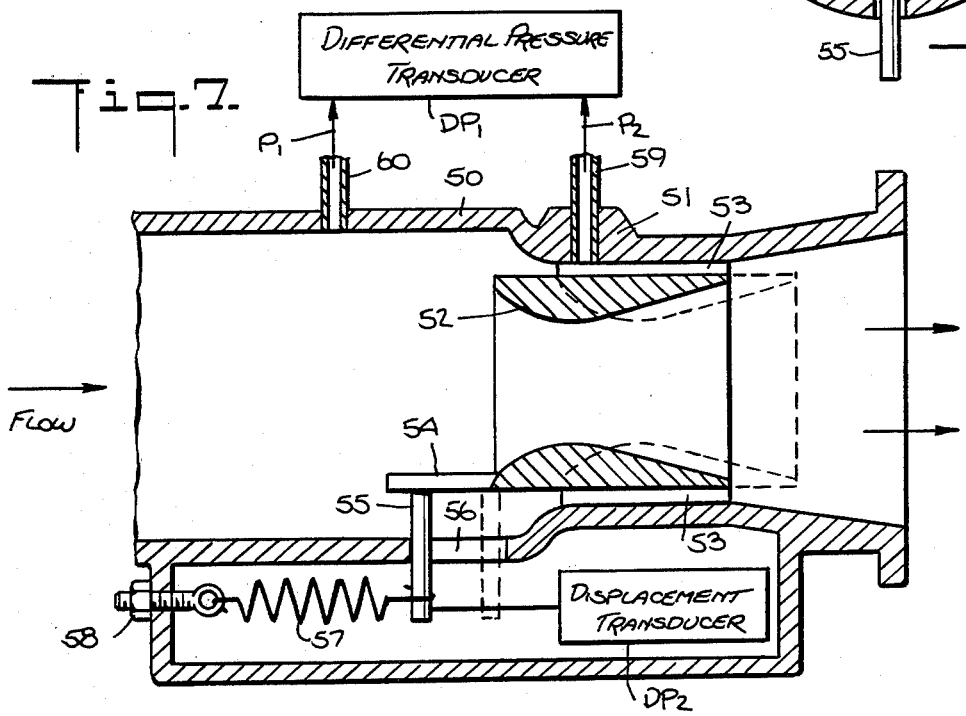

FLUIDIC CONTROL SYSTEM INCLUDING VARIABLE VENTURI

RELATED APPLICATION

This application is a continuation-in-part of my copending application Ser. No. 214,626, filed Dec. 10, 1980, (now U.S. Pat. No. 4,308,835) entitled "Closed-Loop Fluidic Control System for Internal Combustion Engine," which in turn is related to earlier-filed applications identified therein, the entire disclosure of my copending application and of the earlier-filed related applications being incorporated herein by reference.

BACKGROUND OF INVENTION

This invention relates generally to fluidic metering, proportioning and blending systems, and more particularly to a system provided with a variable Venturi structure whose movable element is automatically shifted as a function of the mass-volume of the fluids passing through the structure to provide outputs representative of the volume and density or mass of the fluids.

A system in accordance with the invention is applicable to internal combustion automotive engines to so proportion the ratio of combustion air to fuel as to maintain an optimum ratio thereof under varying conditions of load and speed throughout a wide operating range, thereby attaining higher combustion efficiency, significantly increased fuel economy and reduced emission of pollutants.

The function of a carburetor is to produce the fuel-air mixture needed for the operation of an internal combustion engine. In the carburetor, fuel is introduced in the form of tiny droplets in a stream of air, the droplets being vaporized as a result of heat absorption in a reduced pressure zone on the way to the combustion chamber whereby the mixture is rendered inflammable. In a conventional carburetor, air flows into the carburetor through a Venturi tube and a fuel nozzle within a booster Venturi concentric with the main Venturi tube. The reduction in pressure at the Venturi throat causes fuel to flow from a float chamber in which the fuel is stored through a fuel jet into the air stream. The fuel is atomized because of the difference between air and fuel velocities.

Although most carburetors today use double and triple Venturis to multiply suction forces, the fixed sizes of these Venturis, usually determined by the mid-range capacity of the engine, gives rise to fuel induction throughout approximately one-half the automotive operating range. The lack of Venturi-carburetion action at idle and slow speeds makes it necessary to introduce fuel downstream of the Venturi by means of the high vacuum developed by partially-open throttle plates. At higher speeds and power, air bleeds are needed to moderate excessive enrichment by the higher Venturi velocities. And under maximum power when the Venturi vacuum is moderate, additional fuel is supplied by means of power jet, stepped needle valves or auxiliary barrels.

Thus existing techniques for regulating the fuel-to-air ratio throughout the existing range from idle to full power, represent, at best, a compromise dictated by the above-noted limitations, fuel efficiency being poor at idle, low speeds and high power. Moreover, the overcome acceleration "flat spots" encountered during transitions in driving modes, throttle-actuated fuel pumps are employed to spray additional fuel into the air stream, thereby rendering the system even less efficient.

Other popular carburetors make use of the manifold vacuum to operate air-flow valves coupled to stepped or tapered needle valves, fuel being introduced eccentrically in non-Venturi passages. Existing systems of fuel injection for internal combustion engines produce air-fuel mixtures by means of pressurized fuel nozzles for timed or continuous spray into the air stream. A hybrid system called "throttle-body injection" utilizes pulsed electric injectors directly into the air stream above the throttle plates. All such systems rely on gathering data on a variety of operating engine variables, and the continuous monitoring of these factors, this data being fed to a mini-computer to produce the electric pulses that control the intermittent supply of fuel. These systems to not fully take into account the requirements for gasifying the fuel-to-air mixture; and even though they act to manipulate the fuel-to-air ratio, combustion efficiency is sacrificed.

The behavior of an internal combustion engine in terms of operating efficiency, fuel economy and emission of pollutants is directly affected both by the fuel-air ratio of the combustible charge and the degree to which the fuel is vaporized and dispersed in air. Under ideal circumstances, the engine should at all times burn 14.7 parts of air to one part of fuel within close limits, this being the stoichiometric ratio. In the actual operation of a conventional system, richer than stoichiometric is required at idle and slow speeds for dependable operation, whereas leaner than stoichiometric is desirable at higher speeds for reasons of economy. The employment of Lambda oxygen exhaust sensors and feedback controls to maintain the stoichiometric ratio for catalytic control of emissions is at the expense of performance and economy.

Maximum fuel economy and minimum emission of pollutants have heretofore been considered to be mutually exclusive due to the practical limitations of presently available systems. These limitations stem from the inability to "gasify" liquid fuel in air from idle to full speed and power before ignition in the engine. By the term "gasify" is meant fuel that has been dispersed, vaporized and homogenized to a gaslike quality. At or about the stoichiometric ratio of such gasified air-fuel mixtures, the most complete combustion with minimum emissions will result.

In my above-identified copending application of which the present case is a continuation-in-part, there is disclosed a closed loop engine control system acting to maintain that ratio of air-to-fuel which represents the optimum ratio for the prevailing condition of engine speed and load. The system includes a variable-Venturi carburetor which atomizes and disperses the fuel in the air whereby the system not only brings about a marked improvement in fuel economy but also substantially reduces the emission of noxious pollutants.

In the closed-loop system disclosed in my copending application, the variable Venturi structure is constituted by a cylindrical casing and a cylindrical booster coaxially disposed therein whose internal surface has a Venturi configuration to define a primary passage. This primary booster may consist of two concentric venturis in a step arrangement. Interposed between the booster and a section of the casing wall having an external Venturi configuration is an axially shiftable spool whose internal surface has a Venturi configuration to define between the booster and the spool a variable secondary passage whose effective throat size depends on the axial position of the spool. A tertiary passage is defined between the outer surface of the spool and the casing section. Air passing through the Venturi structure flows through all three passages.

An air-fuel dispersion is fed by a nozzle into the primary passage to intermingle with the air flowing therethrough to form an atomized mixture which is fed into the secondary passage to intermingle with the air flowing through the throat thereof, from which secondary passage the mixture intermingles with the air flowing through the tertiary passage, the total thereof being fed into the intake manifold of the engine.

The closed loop system disclosed in my copending application adjusts the position of the axially-shiftable spool by the application of the differential-pressure signal taken at the stationary tap in the tertiary passage at the casing wall to a fluidic amplifying and servo system, thereby controlling fuel flow proportionate to air flow throughout the operating range.

The system includes a vacuum amplifier constituted by a vacuum-regulating valve in a vacuum chamber coupled to the intake manifold of the engine and controlled by a diaphragm and spring assembly which responds to the pressure differential vacuum signal developed between the input and throat of the Venturi. The vacuum chamber yields a strong vaccum output directly proportional to the Venturi pressure differential signal.

The amplified vacuum output is applied to a bidirectional, spring-return vacuum motor operatively coupled to the Venturi spool which acts to axially shift the spool in a direction and to an extent bringing about the desired ratio of air-to-fuel, either by proportioning the fuel flow by the direct effect of the Venturi pressure differential acting on the fuel or by regulating, in accordance with the Venturi pressure differential, the fuel fed to a nozzle or injector in those applications where a pressurized fuel feed is desirable.

SUMMARY OF INVENTION

In view of the foregoing, the main object of this invention is to provide a fluidic control system having a variable Venturi structure whose movable element is automatically shifted as a function of the mass-volume of fluid passing through the structure to yield an output which depends on the adjusted position of the element or the resultant velocity-pressure.

A system in accordance with the invention is usable generally for metering, proportioning and blending fluids. In the context of an internal combustion automotive engine in which the variable Venturi structure acts to intermingle combustion air and fuel prior to ignition, the system develops a stoichiometric or other ratio of air-to-fuel that represents the optimum value for the prevailing condition of engine speed and load throughout a broad operating range, thereby effecting a marked improvement in fuel economy and substantially reducing emission of noxious pollutants.

A salient advantage of a system in accordance with the invention, as distinguished from existing carburetion arrangements which entail auxiliary devices and other expedients to make up for the lack of Venturi carburetion action at idle and slow speeds, and which also require other auxiliary devices for operation at high speeds or to take care of acceleration "flat spots," is that the variable Venturi structure requires no such auxiliary expedients, yet affords the optimum air-fuel ratio for the full range of conditions encountered in operating a vehicle.

A significant feature of the present invention as distinguished from the closed-loop system disclosed in my copending application is that it functions in an open loop manner and obviates the need for a feedback motor to adjust the movable element in the Venturi structure, thereby simplifying the arrangement without, however, sacrificing the principal advantages thereof.

Also an object of this invention is to provide a self-regulating automatically-controlled open loop carburetion system for an internal combustion engine which is constituted by relatively simple and durable mechanical components that can be maintained and readily repaired or replaced, both in the shop and in the field, by personnel of ordinary mechanical skills.

Yet another object of this invention is to provide a self-regulating, extended-range system including a variable Venturi structure which lends itself to low-cost, mass production and which, because of its uncomplicated nature, can be used to retrofit an existing engine and thereby upgrade its performance in terms of smoothness of operation and efficiency.

A further object of this invention is to provide a system in which the moveable element in the Venturi structure is displaced by the fluid flow force generated in the structure, this being counterpoised by a spring whose spring rate may be programmed to obtain a desired pattern for engine behavior.

A further object of this invention is to provide manual or automatic means to alter the spring rate program either by operator selection or from engine operating variables in a closed loop manner.

Briefly stated, these objects are accomplished in a self-regulated automatic Venturi structure for supplying a fuel-air mixture to the intake manifold of an internal combustion engine in a ratio appropriate to the prevailing condition of engine speed and load throughout a wide operating range. The structure includes a spring-biased, axially-shiftable spool whose contoured inner surface has a Venturi configuration to defined a passage through which flows incoming air intermingled with fuel drawn or injected therein.

The axial position of the spool in relation to a stationary throat line determines the area of opening at the effective throat, this opening determining the magnitude of the velocity-pressure, also referred to as "Venturi vacuum." The spool is subjected to the hydrodynamic force produced by the air-fuel-mixture flowing therethrough, this force acting against the spring to displace the spool to an extent producing the effective throat opening which results in a fuel-air ratio appropriate to the prevailing condition.

OUTLINE OF DRAWINGS

For a better understanding of the invention as well as other objects and further features thereof, reference is made to the following detailed description to be read in conjunction with the accompanying drawings, wherein.

Figure 4:
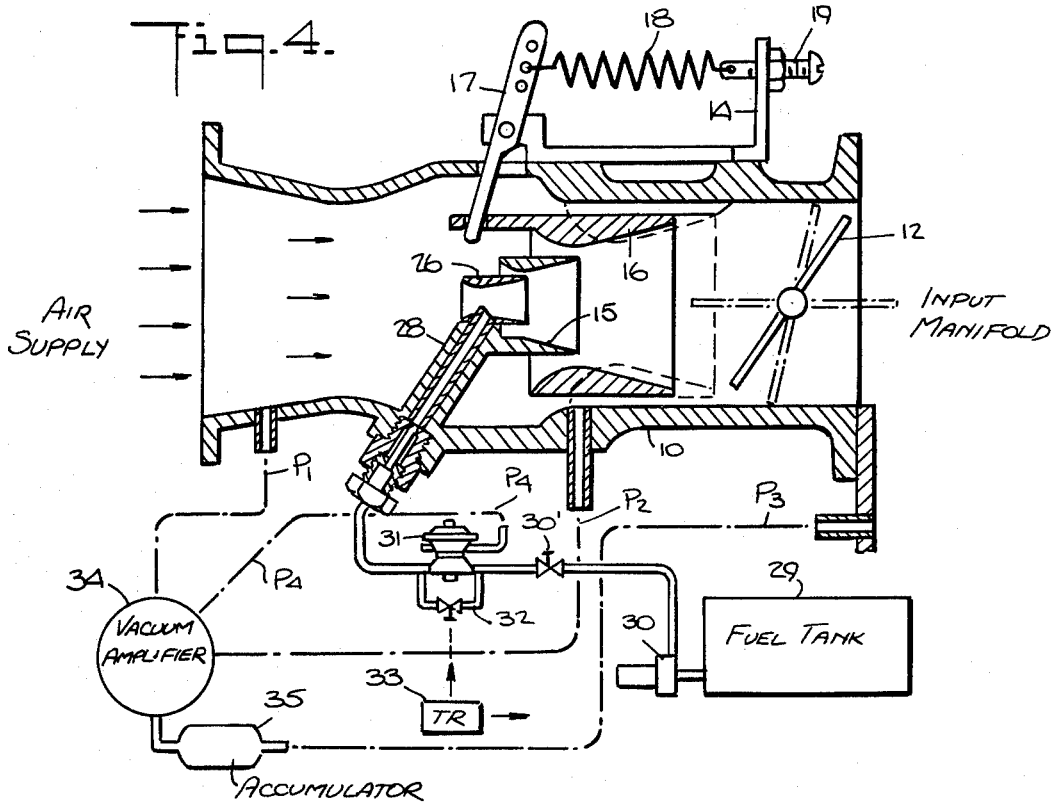
Figure 6:
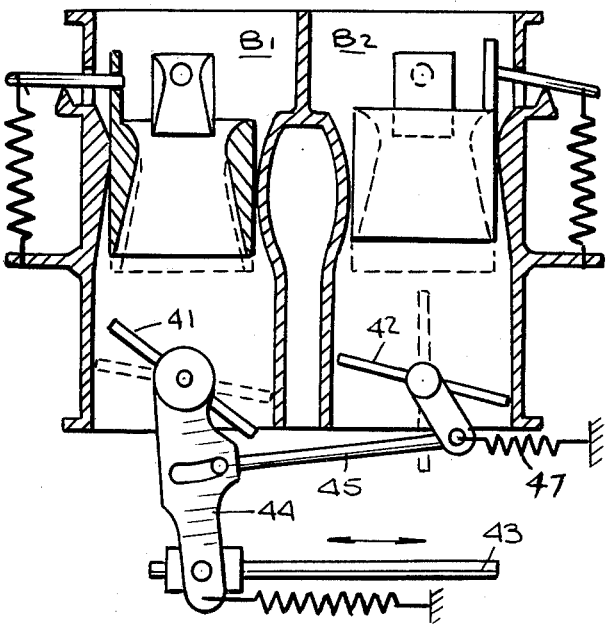
Figure 2:
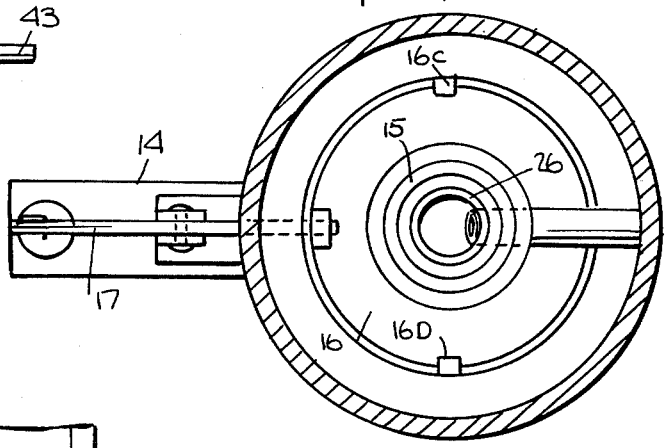
FIG. 2 is a top plan view of the structure shown in FIG. 3.
Figure 9:
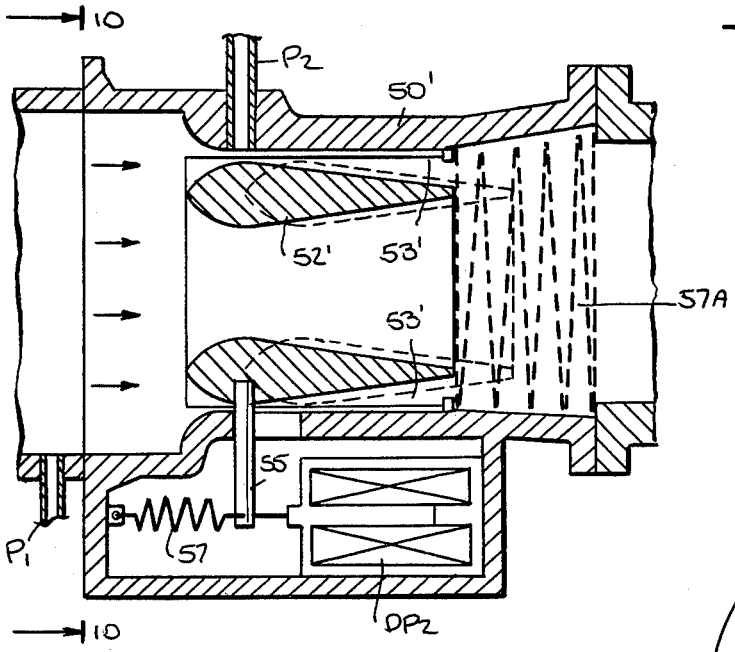
Figure 10:
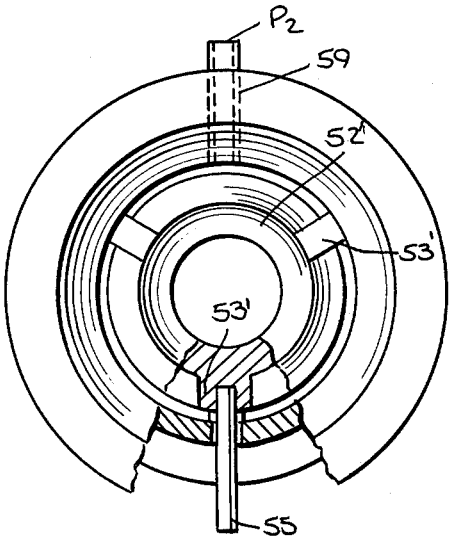
Figure 11:
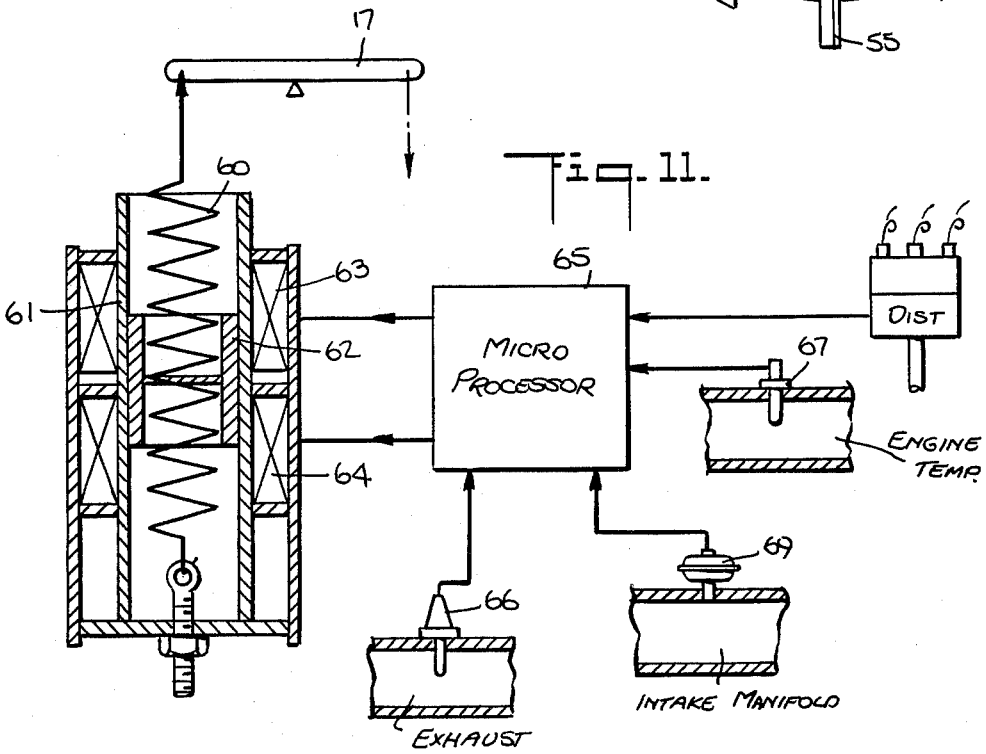
Figure 12:
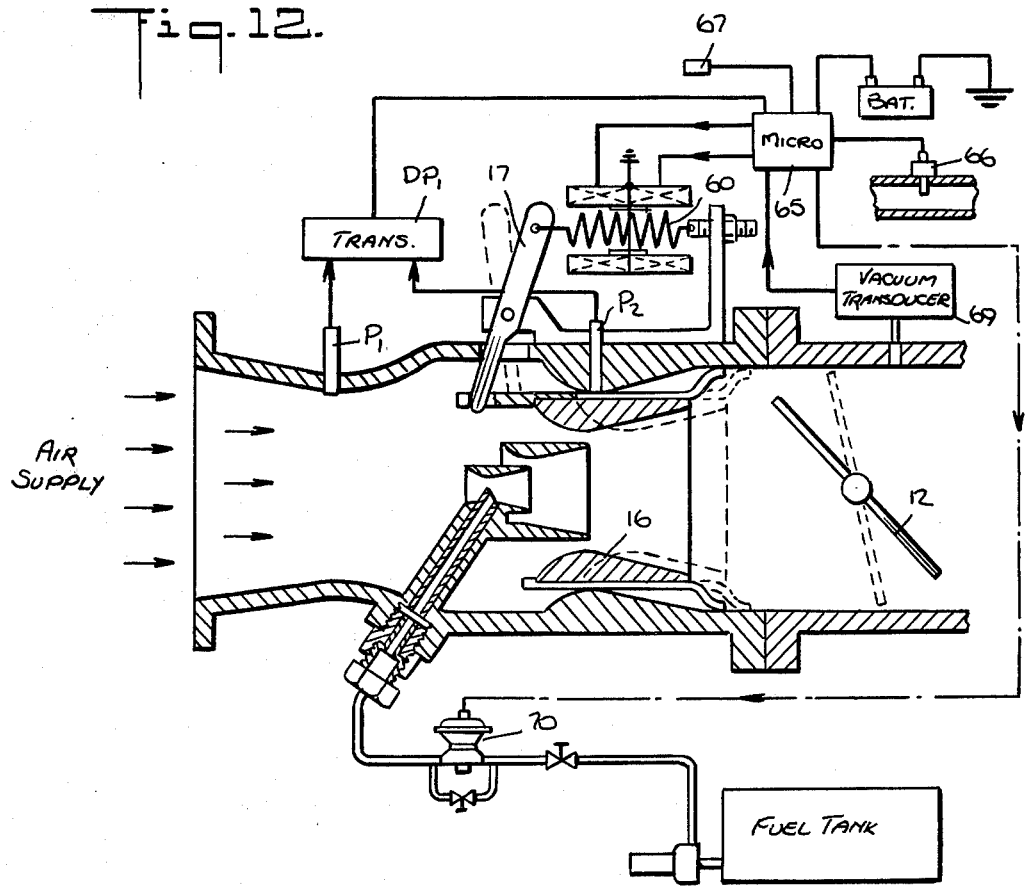
Figure 14:
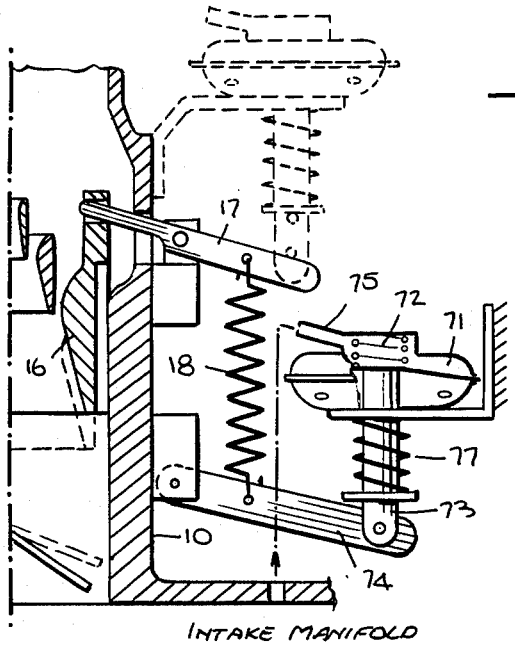

FIG. 4 schematically illustrates in section a variable Venturi structure in accordance with a second embodiment of the invention;

FIG. 5 shows in a third embodiment a doubld-barrel Venturi structure with synchronized spools;

FIG. 6 shows a progressive double-barrel Venturi structure in accordance with a fourth embodiment;

FIG. 7 shows a fifth embodiment of a variable Venturi structure for metering fluids;

FIG. 8 is an end view of FIG. 7;

FIG. 9 is a modified form of the structure shown in FIG. 7;

FIG. 10 is an end view of FIG. 10;

FIG. 11 illustrates schematically an electronic system for adjusting the spring rate of the spool spring in a variable Venturi structure in accordance with the invention;

FIG. 12 illustrates the electronic system for adjusting the spring rate in a fuel injection variable Venturi control structure;

FIG. 13 illustrates one pneumatic arrangement for adjusting the spring rate; and FIG. 14 illustrates another pneumatic arrangement for adjusting the spring rate.

DESCRIPTION OF INVENTION

General Introduction

In an automobile powered by an internal combustion engine, the engine speed, the air valve or throttle position and the intake manifold pressure are the determinants for the operating conditions of the engine when it is warm. These characteristic determinants are interrelated, the fuel requirements of the engine being governed by the instantaneous state thereof. In order, therefore, to optimize the combustion efficiency of the engine, the present invention provides a self-regulating variable Venturi carburetor system which governs the air-fuel ratio in real time, the system being rapidly responsive to changes in engine speed and load whereby transitions are smooth and bumpless.

By combustion efficiency is meant power economy expressed in miles per gallon and complete combustion of the available fuel to minimize the emission of unburned hydrocarbons and carbon monoxide. For purposes of combustion efficiency, not only is it necessary to accurately proportion the amount of fuel to air in the mixture to satisfy existing engine conditions, but the air and fuel must be thoroughly intermingled, atomized and vaporized to a gas-like consistency. Failure to accomplish this objective results in incomplete combustion, as a consequence of which carbon monoxide and hydrocarbons are exhausted from the engine with an attendant loss of combustion efficiency.

The present invention can best be appreciated by first summarizing the essential features of the closed-loop fluidic control system disclosed in my copending application, for the present invention accomplishes similar results by less complicated means in an automatic variable Venturi structure in a programmed open loop system that not only provides additional advantages but is also applicable to fluidic proportioning and blending in fields other than in automobile engines.

The term "Venturi Structure," as used herein, refers to a structure invented by Venturi to measure the flow of fluids and gases by means of a tube whose inlet or entry section converges toward a constricted throat section which in turn leads to a diverging outlet section, all sections having a circular cross section. In the structure disclosed in my copending application, an upstream tap in the input conduit to the Venturi structure makes available the input static pressure ($P_1$), while a tap at the effective throat provides a static pressure ($P_2$), which is less than that at the upstream tap, such that the differential pressure ($P_1$-$P_2$) is a function of the velocity of air passing through the structure, and is a measure, therefore, of the instantaneous volume.

In order to obtain an accurate indication of air flow velocity, it is important in the variable Venturi structure that a circular cross section thereof be maintained at all adjusted positions, and that the static pressure ($P_2$) at the effective throat is derived from a tertiary passage through which no fuel passes. This tertiary passage constitutes, as it were, an air envelope surrounding the air-fuel mixture, so that a tap therein provides the velocity pressure $P_2$ of the total volume of fuel-air mixture and air flowing through the cross-sectional plane that includes all passages.

Control of the air-fuel ratio is effected in the multipassage variable-Venturi carburetor structure operating in an arrangement wherein the fuel is either induced into the Venturi primary passage or is supplied thereto under pressure. The term "pressure feed" is used rather than conventional fuel injection; for in my copending application and in the present case, carburetion and injection take place concurrently, so that the pressure feed arrangement represents a hybrid of induction and injection. Whether of the inductive or pressure feed type, the fuel, before being admitted into the Venturi, is first partially dispersed by means of an air tube which induces air into the fuel being fed into the primary passage, the mixture being rendered turbulent and less dense, further mixing with combustion air in the secondary passage in a low-pressure, high velocity environment to vaporize the fuel in air, the merged primary and secondary passage having a variable throat.

In a closed loop fluidic control system of the type disclosed in my copending application, the differential pressure $P_1$-$P_2$ developed between the air inlet to the Venturi structure and the throat tap of the tertiary passage is sensed in a vacuum amplifier producing a proportional amplified vacuum that is applied to a vacuum motor acting to adjust the Venturi throat in the secondary passage to provide the velocity-pressure serving to regulate the relative volume of fuel in the mixture to produce an air-fuel ratio appropriate to the prevailing conditions of speed and load. The vacuum amplifier is coupled to the intake manifold of the engine, and is modulated by a balanced diaphragm and valve assembly responsive to the Venturi pressure differential signal to produce a strong vacuum output signal that is derived from the existing manifold vacuum and is a function of the differential air-flow pressure, this output signal powering the vacuum motor.

In the inductive feed arrangement, the differential pressure is the controlling force which directly acts on and determines the volume of fuel entering the air stream via a nozzle feeding the primary passage of the Venturi structure. In the pressure feed arrangement, the differential pressure ($P_1$-$P_2$) is applied to a vacuum flow regulator that controls the pressurized feed of the fuel into the Venturi primary passage.

In an open-loop system provided with a variable Venturi structure in accordance with the invention, as applied to an internal combustion engine, instead of adjusting the effective throat by means of a vacuum motor, the axially-shiftable spool whose position sets the effective throat opening, is spring biased and is diplaced against the tension of the spring by the hydrodynamic force generated by the air-fuel mixture flowing therethrough. This force is a function both of the differential static pressure and the impact pressure exerted by the mass-flow of the fuel-air mixture, thereby obviating the need for a vacuum motor. Such automatic adjustment of the effective throat produces the static velocity pressure which controls the flow of fuel into the air stream directly or indirectly to maintain a ratio appropriate to the prevailing conditions of speed and load throughout the full operating range of the engine.

First Embodiment

Figure 1:
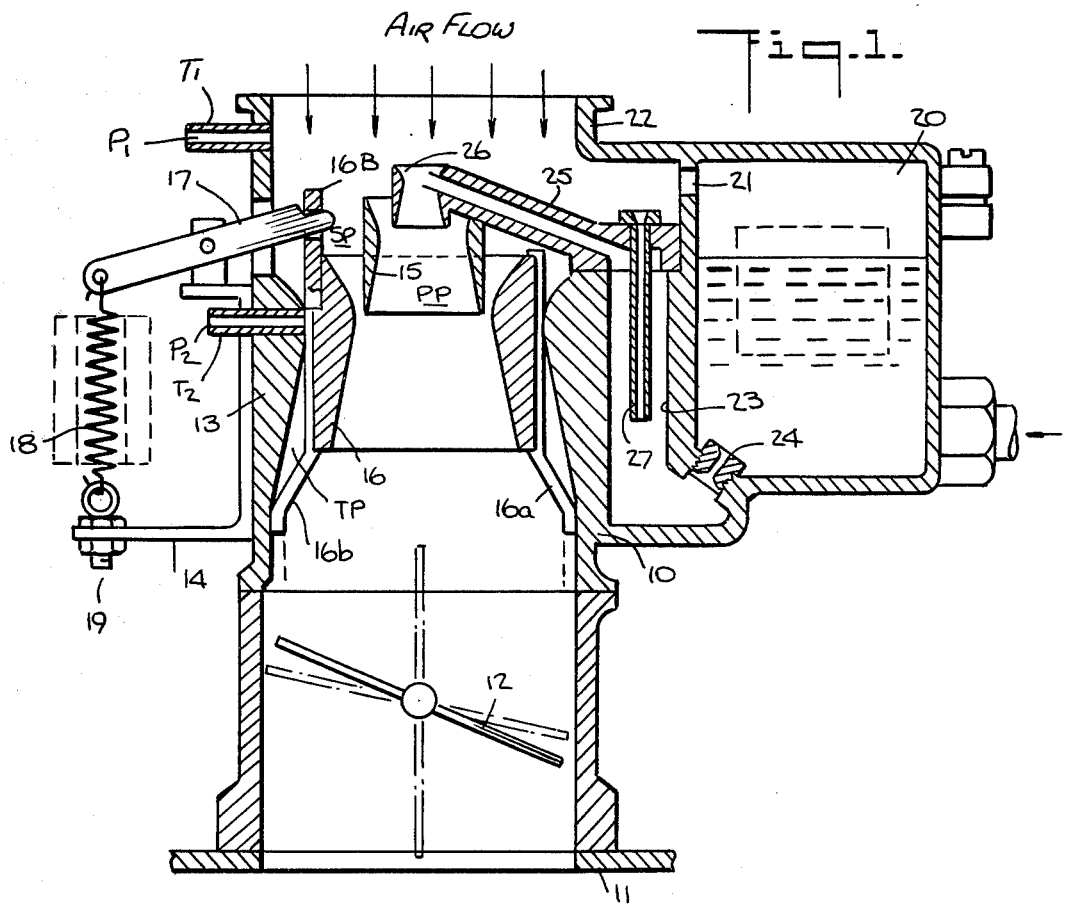
FIG. 1 is a sectional view of a variable Venturi structure in accordance with a first embodiment of the invention.

The self-regulating variable-Venturi structure of the type shown in FIG. 1 is a three-stage structure having a tubular casing 10 into which an air stream at atmospheric pressure is introduced. The lower end of casing 10 is coupled to the intake manifold 11 of the internal combustion engine through a duct having a foot-operated throttle 12 therein. It is to be understood that the invention is not limited to the three-stage structure shown herein, and that it is applicable to other forms of variable Venturi structures of the type shown in my earlier filed applications. Disposed in the mid-section of casing 10 is a stationary ring 13 having an external Venturi coutour. Mounted coaxially within casing 10 is a cylindrical booster 15 having an internal Venturi configuration to define a primary passage PP. The Venturi structure further includes an axially-shifted cylindrical spool 16 interposed between booster 15 and ring 13. The outer surface of spool 16 is a true cylinder, whereas the contoured inner surface has a Venturi configuration and forms with the outer surface of booster 15 a second Venturi passage SP whose inlet has a parabolic formation leading to a constricted throat.

While the inlet section or entry of spool 16 may have a straight tapered formation, the value of a parabolic surface lies in the linear change in cross-sectional area that occurs with linear axial movement of spool 16 in response to the hydrodynamic force imposed thereon.

The exterior surface of spool 16, while having a uniform cylindrical form, defines an annular tertiary Venturi passage TP in conjunction with Venturi configured casing ring 13 which has a constant cross section in all axial positions of spool 16 to provide an ideal air metering means.

The interior shape and axial position of spool 16 determines the air velocity vs. cross-sectional area characteristics of the multiple Venturis defined by (a) the exterior surface of spool 16 with respect to Venturi ring 13, (b) the interior surface of spool 16 respect to the outlet end of booster 15, and (c) the interior surface of booster 15 at this end. The total of the areas of all passages taken in the reference plane of the outlet end of booster 15 is the effective throat of the composite structure. The area of this effective throat therefore varies as the spool is axially shifted.

To improve the volumetric efficiency of the Venturi structure by avoiding linkage mechanisms for the spool which project into the flow passage, the outer surface of spool 16 is provided at diametrically-opposed positions with two pairs of guide ribs or fins 16A-16B and 16C-16D which are slidably received in Venturi ring 13 and the interior of tubular casing 10.

Spool 16 is provided with an extension 16B' of rib 16B to serve as an upper handle which is linked to one end of a crank 17 pivotally mounted on a bracket 14 secured to the exterior wall of Venturi casing 10. The other end of crank 17 is coupled to a helical tension spring 18 which is anchored on bracket 14 by means of a set screw 19 serving to adjust the spring tension. Thus spool 16 is spring biased, the spool being normally maintained by the spring at its uppermost axial position at which the effective throat defined by spool 16 and booster 15 has a minimum opening. As spool 16 moves downwardly, the opening of this effective throat is progressively enlarged.

Adjacent casing 10 is a liquid fuel float chamber or reservoir 20, the upper end of which is vented through an opening 21 leading into the air inlet 22 of the Venturi structure. Fuel is drawn by induction from chamber 20 through a vertical passage 23 having a fuel jet orifice 24 at its lower end, the upper end of tube 23 communicating through a connecting duct 25 terminating in a Venturi nozzle 26 which is supported by the duct coaxially within booster 15 of the Venturi structure.

Air for dispersing the fuel is introduced into fuel tube 23 by way of an air induction tube 27, whose inlet terminates in the fuel tube below the normal fuel level. Inlet 29 of the air tube communicates with the air inlet 22 of the Venturi structure. The differential pressure created between inlet air pressure $P_1$ and the effective throat pressure $P_2$ acts on the fuel nozzle 26 and its connecting passage 25 to fuel tube 23 to draw fuel through jet-orifice 24 and air through tube 27.

Air is injected into the fuel before the fuel is fed into the carburetor, the injected air bringing about a liquid fuel dispersion which promotes vaporization and reduces the fuel density, which in turn facilitates control of fuel "lag." The air/fuel dispersion is proportioned and maintained by the fixed orifices of fuel and air tubes, the quantity of dispersion induced into the primary passage depending on the prevailing pressure differential of air input pressure ($P_1$) less the effective throat pressure ($P_2$).

Thus flowing through the secondary passage SP and the tertiary passage TP in the structure is the throttle-controlled air entering the Venturi through inlet 22 as well as the fuel-air mixture passing through the primary passage PP. The combination of these flows imposes a hydrodynamic force on the contoured inner surface and outer surface of spool 16 which acts to displace the spool axially in the downstream direction against the tension of the spring 18 which seeks to hold the spool at its upstream axial limit position. The extent of displacement is a direct function of the applied force: the greater the force, the larger the effective throat opening. As used herein, the term "hydrodynamic force" includes the aerodynamic force imposed by dispersed liquid gases and air on the spool.

The present invention is not limited to a helical compression spring as shown; for the spring may be in conical, torsional, leaf and in any other structural form producing a deflection which is proportional to the applied load. The ratio of load to spring deflection is known as the spring rate or spring constant.

Assuming a linear spring rate, the axial displacement in response to the hydrodynamic force imposed therein depends on the prevailing mass-flow rate. It is to be noted that the annular throat and differential pressure tap $P_2$ of the tertiary passage TP lies in the same plane as the annular throat of the secondary passage SP and at the outlet of the primary passage defined by booster 15 which also lies in this plane. Consequently, an axial shift in spool 16 results in a change in the opening of the throat in secondary passage SP, resulting in a change in pressure $P_2$ developed at the effective throat of the structure. Pressure $P_2$ acts through booster 15 and nozzle 26 in fuel tube 25 in a manner whereby the amount of fuel drawn out of the reservoir through nozzle 26 is proportional to the mass of the air-fuel mixture. As spool 16 moves up and down in response to changes in the mass of the mixture, effective throat pressure $P_2$ compensates for the changing mass of the mixture, and the amount of fuel intermingled with the air is varied accordingly.

Thus as the engine goes from idle to maximum speed and maximum power, the self-regulating variable Venturi structure acts to modulate the fuel-air ratio to optimize this ratio for the conditions which prevail throughout the full operating range of the engine, all expedients heretofore required for this purpose being obviated by the invention.

Figure 3:
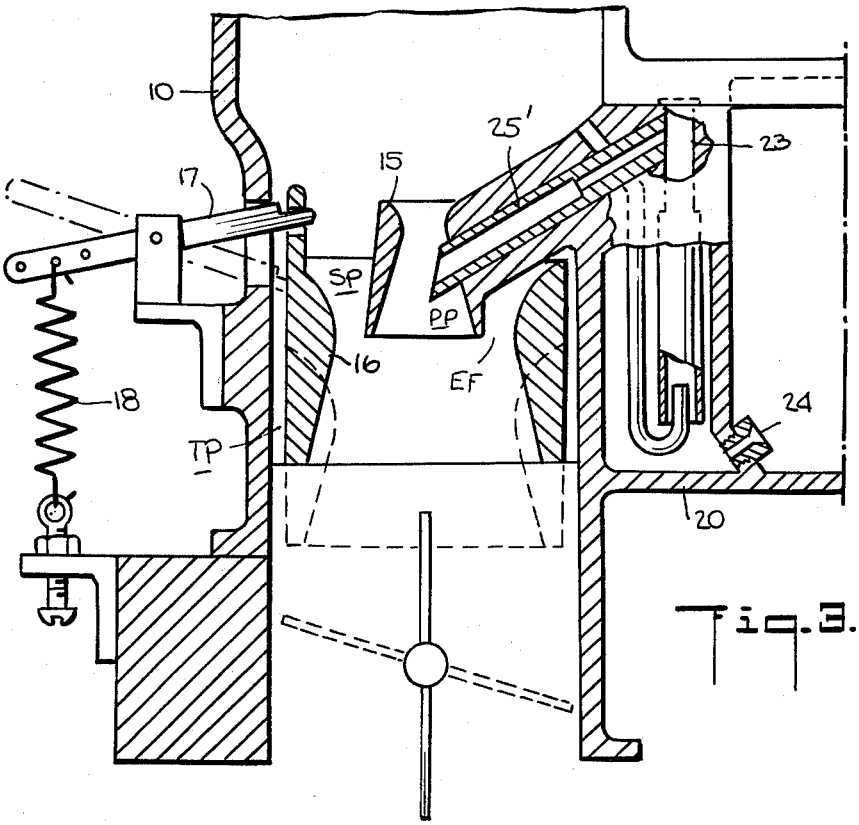
FIG. 3 is a sectional view of a modified form of variable Venturi structure.

Referring now fo FIG. 3, there is shown a modified form of Venturi structure in which the casing 10 has no Venturi ring on its inner surface as in FIG. 1, the inner surface in this instance being a pure cylinder. It will be seen that the effective throat EF lies in a plane which passes through the outlet end of booster 15 (as in FIG. 1), the size of this throat and the pressure $P_2$ depending on the axial position of spool 16.

The cylindrical interior surface of casing 10 is somewhat better adapted for the guided movement of the axially-shiftable spool by means of external ribs than a surface having a Venturi ring therein. The uniform tertiary passage TP defined by the cylindrical interior surface of casing 10 and the cylindrical outer surface of spool 16 provides an air flow passage which in the context of induction carburetion serves only to prevent wetting of the surface and to aid in vaporization.

As applied to carburetors to which the effective throat pressure $P_2$ acts internally on the fuel supply, there is no intrinsic need for the tertiary passage in the variable Venturi structure. However, in the other embodiments in which the effective throat pressure $P_2$ is externally applied, then in these embodiments a tertiary passage is called for in order to make it possible to provide a pressure tap in the outer casing in line with the plane of the effective throat. A tap $T_2$ of this type is shown in FIG. 1 as well as tap $T_1$ for picking up inlet pressure $P_1$.

In all other respects, the structure in FIG. 3 is essentially the same as in FIG. 1, except that in FIG. 3 fuel is not fed into booster 15 by way of a Venturi nozzle but by means of an inlet duct 25' connected to duct 23.

Second Embodiment

In those applications where fuel-controlled reservoirs may be undesirable as a fuel source, use may be made of a fuel supply wherein pressurized fuel is fed, as shown in FIG. 4, to nozzle Venturi 26 through an injection nozzle 28. In this instance, a fuel pressure feed is employed in which fuel from a tank 29 is forced by pump 30 through a solenoid shut-off valve 30' and a pressure-regulated flow-control valve 31 to nozzle 28. Priming for engine starting is by means of a solenoid bypass valve 32 controlled by a timing relay 33.

In this mechanical fluidic arrangement, a vacuum amplifier 34 is provided of the type disclosed in my U.S. Pat. No. 4,308,835 which responds to three pressure variables, the first being pressure $P_1$ picked up at the inlet to the Venturi structure. The second pressure $P_2$ is picked up at the throat of the Venturi structure. The third pressure $P_3$ is the negative or vacuum pressure picked up at the intake manifold 11 to which the Venturi is coupled.

Vacuum amplifier 34 yields an output pressure $P_4$ which is derived from the intake manifold pressure $P_3$ as modulated by the difference between inlet pressure $P_1$ and effective throat pressure $P_2$. Output pressure $P_4$ is applied to valve 31 to effect an adjustment thereof to control the injecting fuel supply accordingly. An accumulator 35 provides a continuous supply of vacuum power to vacuum amplifier 34.

Thus in the arrangement shown in FIG. 4, the spool is axially shifted in response to the hydrodynamic force imposed thereon, the resultant pressure differential produced in the Venturi acting to modulate the injected fuel feed accordingly. Most of the interacting and interrelated variables involved in the behavior of the engine are taken into account to automatically regulate the ratio of air-to-fuel throughout the full spectrum of the prevailing speed and load conditions encountered under both ordinary and extraordinary conditions to optimize combustion efficiency.

Third Embodiment

The automatic Venturi structure may be incorporated, as shown in FIG. 5, in a typical double barrel carburetor with a dual throttle. This provides increased capacity in a compact arrangement. In this instance, each barrel includes a Venturi structure and a fuel jet supplied from a common reservoir, the structure having an axially-shifted spool 36 and a throttle 37, the two throttles being ganged for concurrent operation.

The two spools 36 are ganged by means of a cross bar 38 coupled to one end of a crank 39 whose other end is coupled to a spring 40 so that the spring is common of both spools and the dual variable-Venturi structures operate in unison.

Fourth Embodiment

The automatic Venturi structure in a progressive two-barrel arrangement as shown in FIG. 6 provides the most efficient arrangement for engines of greater speed and power range. In this instance, each barrel ($B_1$ and $B_2$) includes a totally independent automatic Venturi structure, programmed spring, fuel supply and modulating devices and throttle valves. The essential difference resides in the linking of the throttle blades 41 and 42 to the pedal rod 43 or manual operator so that one barrel throttle opens first while at approximately $\frac{1}{3}$ to $\frac{1}{2}$ open position, the second barrel starts to open. And as the operator continues to open, both progress at a rate that attains full opening simultaneously.

Conversely, the second barrel closes first reaching full closure while the first barrel throttle is at its $\frac{1}{3}$ to $\frac{1}{2}$ open position, and the first throttle 41 closes to the idle stop position. The important consideration in this application requires that both barrels and throttles supply a common plenum of central intake manifold. For divided manifolds two such progressive double barrel arrangements must be applied.

While the float controlled fuel reservoirs are usually common to the 2-barrel units, it is obvious that individual carburetors or injection carburetors may be used by the application of the progressive throttle linkage for a common manifold. Also, while this embodiment illustrates the progressive or differential arrangement of two Venturi structures, the self-regulating nature of the spring control for each structure makes it feasible to effect progressive throttle linkage of more than two Venturi structures.

FIG. 6 illustrates a suitable progressive linkage in which the first barrel throttle 41 is linked to the foot pedal operating rod 43 which controls throttle 41 in a conventional manner. If desired, this may be equipped with the usual idle stops, fast idle cams and stop solenoids. Fastened to the shaft of throttle 41 is a slotted cam-radius arm 44, in the slot of which one end of connecting rod 45 is slideably retained. The other end of rod 45 is pivotally retained in lever arm 46 which is keyed to the shaft of second throttle 42.

Slotted cam 44 is so positioned on throttle shaft 41 that from the stop or idle position to approximately ⅓ opening, cam movement is not transmitted to rod 45 and throttle 42. The effect of this is to allow opening and closing of throttle 41 and the fueling of the engine from only one barrel until the operator causes throttle 41 to open wider, after which throttle 42 proceeds to open.

Since the air-fuel ratio in either barrel depends on the volume of air flow therethrough and is independent of the other barrel, this arrangement provides accurate control of fuel-air ratio throughout a greater range of engine capacity.

The ratio of the radius of slot-cam 44 to that of lever 46 is such as to cause full opening of throttle 42 with a ⅔rds opening of throttle 41. Throttle 42 is biased by tension spring 47, whereby the closing of throttle 42 precedes the closing of throttle 41 in reverse order to the opening procedure.

Where individual single barrel carburetors are mounted on individual manifold conduits in a multiple unit Venturi carburetor arrangement, an individual spring may be provided for each Venturi spool, with the throttles for the individual carburetors ganged together.

Fifth Embodiment

Referring now to FIGS. 7 and 8, a system including a variable Venturi structure in accordance with the invention is shown operating to provide on-line metering and fluidic control for use in chemical and industrial processing applications which require admixing, blending and proportioning of the fluids being processed.

The Venturi structure is constituted by a cylindrical casing 50 provided with end flanges, making it possible to interpose the casing in the process line through which process fluid flows, the fluid input pressure to the casing being $P_1$. Casing 50 is provided with a converging midsection 51 or throat which leads to a diverging outlet section.

Slideably mounted within midsection 51 is a cylindrical spool 52 whose inner surface has a Venturi configuration. Midsection 51 is provided with an array of equispaced ribs 53 which guide the spool in the converged midsection and which define an annular space between the spool and the midsection to allow for fluid flow therethrough. A bar extension of spool 16 provides a spool handle 54 to which is attached a pin 55 that projects through a slot 56 in the casing. Pin 55 is coupled to one end of a tension spring 57 whose other end is anchored by an adjustable eye screw 58 mounted on a bracket attached to the exterior wall of the casing. Alternatively, while the spool has an exterior Venturi configuration, guide ribs are affixed thereto which slide within slots in casing 50 which then has a smooth cylindrical inner surface.

Slot 56 forms the limit stops for axial displacement of the spool, such that at zero flow, the throat of the Venturi formed within the spool lies in a plane intersecting a tap 59 in the converging midsection 51 of the casing. From tap 59, one obtains the pressure value $P_2$, this tap being located between ribs 53. Spool 52 is displaced axially by the forces imposed thereon. The countervailing spring tension imposed thereon is such that at maximum flow, the inlet end of spool 52 is positioned beyond tap 59; hence the maximum effective throat of the Venturi structure is equal to the casing throat at the converging midsection 51.

While the inlet section of spool 52 may have a straight taper, it preferably is given a parabolic formation, as shown, so that a linear change in cross-sectional area results from a linear axial displacement of the spool in response to the hydrodynamic forces impinging thereon.

An upstream tap 60 is provided to yield the input static pressure $P_1$. Consequently, the pressure differential between tap 60 and tap 59 ($P_1$-$P_2$) is proportional to the volumetric flow, as in a conventional Venturi. However, the hydrodynamic force is constituted both by the surface friction and a force in the downstream direction generated by the Venturi interior surface of the spool, this being analogous to that of an air or hydro-foil. Three forces act to displace the spool against the tension of spring 57 which seeks to hold the spool at its upstream limit position.

The magnitude of the hydrodynamic force is proportional both to the instantaneous ($P_1$-$P_2$) differential pressure and to the extent of axial spool displacement, this magnitude reflecting the mass-volume of the fluid being metered. Hence by a suitable differential pressure transducer $DP_1$ coupled to taps 59 and 60, one may translate the pressure differential ($P_1$-$P_2$) into a signal providing a reading of mass-volume. Or by means of a displacement transducer $DP_2$ mechanically coupled to pin 55, one may obtain a like reading. This mass-volume reading may be used to effect process control for proportioning, blending or mixing purposes.

In the modified arrangement shown in FIGS. 9 and 10, the displacement transducer $DP_2$ is of the inductive type and the displacement spool 52' has a Venturi configuration both in the exterior and interior surfaces thereof in order to enhance the sensitivity of the spool to applied hydrodynamic forces. This is particularly useful for metering gases and light fluids. As an alternative to the external bias spring 57, one may provide an internal tension spring 57A which engages the outlet end of spool 26, this being useful for above-atmospheric pressure systems.

Spring Programming

In some instances, it may be desirable to effect close-loop control of the automatic Venturi structure in which the axially-movable spool is spring biased, in order to be able to reduce or increase the spring tension. Thus by reducing the spring tension relative to the countervailing hydrodynamic force imposed on the spool by the air-fuel mixture, one is then able to lean the fuel-air mixture, and by increasing the spring tension, one is able to enrich the mixture to accommodate the engine to particular operating conditions. To this end, an adjustable rate spring force unit is applied as the countervailing force on the Venturi spool.

As shown in FIG. 11, spring 60 operates within a plastic or non-magnetic guide tube 61. Surrounding the spring is a ferromagnetic ring armature 62, armature 61 being secured thereto at its midsection. Wound about the upper end of guide tube 61 is a first coil 63, and about its lower end is a second coil 64.

When upper coil 63 is energized, ring armature 62 is attracted by the resultant magnetic field and acts to pull the spring in the upward direction, thereby reducing spring tension on the spool crank. When, however, lower coil 64 is energized, the reverse occurs and ring armature 62 pulls the spring in the downward direction to increase spring tension.

The spring rate may be controlled by a microprocessor 65 which is responsive to data derived from various sensors such as the Oxygen-exhaust-sensor 66 from the engine exhaust which produces a signal indicative of air-fuel ratio. Also fed into the microprocessor are signals derived from other operating conditions, such as temperature sensor 67, rpm sensor 68 and intake manifold pressure sensor 69. Microprocessor 65, whose output controls the energization of coils 63 and 64, is programmed to modulate the spring rate in response to the sensed conditions to modify the air-fuel ratio accordingly.

The system as shown in FIG. 11 when applied to carburetors does not require the application of the differential-pressure signal $P_1$-$P_2$.

In a Venturi pressure injection system as shown in FIG. 12, microprocessor 65 receives signals from engine operation sensors, as in the automatic Venturi system for the carburetion system shown in FIG. 11. However, in this instance, since fuel flow is externally controlled in accordance with differential-pressure $P_1$-$P_2$, a differential-pressure transducer $DP_1$ acts to provide this signal to microprocessor 65, the output of which is programmed to control a fuel-flow valve 70 as well as the spring rate of spool spring 60.

When a non-electric, fluidic-mechanical control of spring programming is desirable, the device shown in FIG. 13 provides for a reduction or an increase in the countervailing spring force to cause enrichment or leaning of the fuel-air ratio.

This device, which is shown in conjunction with a variable Venturi structure of the types illustrated in FIGS. 1, 3 & 4. consists of vacuum diaphragm motor 71 whose internal spring 76 and external spring 77 acts on the diaphragm contained in a hermetically-sealed chamber 72 to more or less extend the motor shaft 73 to which the diaphragm is linked. At zero vacuum, the force of springs 76 and 77 is greater than the maximum tension of the Venturi spool spring 18.

In the arrangement shown in FIG. 14, motor shaft 73 is pinned at one end through a slot in a lever 74 whose other end is pivotally fastened to casing 10. The opposite end of the spool spring 18 from the crank arm 17 is fastened to lever 74 at a point intermediate the pivot and shaft 73, whereby movement of shaft 73 in response to motor actuation increases the tension of spring 18 with decreasing volume, or decreases tension with increasing vacuum. Vacuum chamber 72 of motor 71 is connected by a tube 75 to the intake manifold of the engine. An alternative vacuum motor arrangement is shown in dotted lines in an arrangement whereby shaft 73 of motor 71 acts directly on spring 18.

Another useful modification is to apply to a vacuum amplifier (not shown) the pressure values $P_1$ and $P_2$ derived from the Venturi structure, and to have the differential of $P_1$ and $P_2$ modulate in the amplifier pressure valve $P_3$ taken from the intake manifold to produce an output pressure $P_4$ which is supplied to vacuum motor 71 to modulate the spring rate as a function of air flow. This is especially useful for supercharged systems of pressurized air and in throttle valves ahead of the Venturi structure.

This fluidic-mechanical modulation of Venturi spool position by either intake manifold vacuum or amplifier feedback from $P_1$-$P_2$ modulates the differential pressure output ($P_1$-$P_2$) of the automatic Venturi structure and is therefore applicable to the fluidic Venturi pressure injection system shown in FIG. 4. It is obvious that many function factors may be incorporated by fluidic modulation of the intake manifold vacuum $P_3$ that actuates the motor.

While there have been shown and described preferred embodiments of a self-regulating variable Venturi structure for internal combustion engine in accordance with the invention, it will be appreciated that many changes and modifications may be made therein without, however, departing from the essential spirit thereof.

I claim:

1. A variable structure which provides throughout an extended range the characteristics of a Venturi whose differential velocity-pressure output is proportional to the mass-volume of a fluid stream passing therethrough, said structure comprising:

A a tubular casing into which the fluid stream is admitted;

B a cylindrical spool supported within the casing for free axial movement therein, said spool having an interior flow passage, said spool defining an exterior flow passage in the annular space between the spool and the casing which exterior passage is always open in the course of said movement whereby the stream admitted into the casing is divided and flows through the interior and exterior passages, said spool having a Venturi-contoured surface lying in at least one of said passages, causing said stream to exert a hydrodynamic force on the spool which acts to displace the spool axially in the downstream direction; and C means imposing a countervailing force on the spool whereby the extent of spool displacement is the resultant of the hydrodynamic and countervailing forces, said displacement providing a differential velocity-pressure output proportional to the mass volume of the admitted fluid stream throughout an extended range.

2. A structure as set forth in claim 1, wherein said inner wall of said casing has a Venturi form whose throat is provided with a pressure tap, said casing having an inlet tap whereby a pressure differential is developed between said taps when fluid passes through said structure.

3. A structure as set forth in claim 2, further including a differential-pressure transducer coupled to said pressure taps to provide a signal dependent on the mass-volume of fluid passing through the structure.

4. A structure as set forth in claim 1, wherein said countervailing force is provided by a spring operatively coupled to the spool.

5. A structure as set forth in claim 4, wherein said spring is mounted outside the casing and is linked by a crank arm extending through a slot in the casing to the spool, said slot determining the limits of spool movement.

6. A structure as set forth in claim 5, further including an external displacement transducer operatively coupled to said spool to provide a signal depending on the mass-volume of fluid passing through the structure.

7. A structure as set forth in claim 6, further including means to govern the metering of another fluid in proportion to the displacement signal representing the mass-volume of the fluid flowing through the structure.

8. A structure as set forth in claim 7, for regulating the ratio of fuel to throttle-controlled combustion air to produce an ignitable mixture for the intake manifold of an internal combustion automotive engine, said combustion air being fed into the inlet of said casing, said fuel intermingled with air being fed into a fixed booster coaxially disposed with respect to said spool whereby the axial displacement of said spool in response to the resultant hydrodynamic forces provides a ratio of air-to-fuel that is optimum for prevailing conditions of engine speed and load throughout the range of engine operating conditions.

9. A Venturi structure as set forth in claim 8, wherein said fuel is fed into said booster through a nozzle Venturi.

10. A Venturi structure as set forth in claim 8, in combination with means to feed pressurized fuel therein and a vacuum amplifier coupled to the intake manifold and responsive to the existing pressure differential between said taps to derive from the prevailing vacuum in the manifold an amplified output signal which is a function of said pressure differential, and means responsive to said signal to vary the feed of fuel into the carburetor.

11. A plurality of Venturi structures, each as set forth in claim 8, in a multi-barrelled arrangement in which the spools are linked to a common biasing spring and the throttles are ganged.

12. A plurality of Venturi structures each as set forth in claim 8 in a multi-barrel arrangement in which the spools are individually spring-biased and the throttles are differentially linked to effect sequential opening and closing thereof.

13. A Venturi structure as set forth in claim 8, further including means to vary the tension imposed by the spring.

14. A Venturi structure as set forth in claim 13, wherein said spring is provided with a magnetizable element which operates in conjunction with upper and lower coils, which coils, when selectively energized, attract the element in a direction causing a reduction or increase in spring tension.

15. A structure as set forth in claim 14, further including means to sense the air-fuel ratio in the exhaust of the engine and to produce a signal representative thereof, and a microprocessor responsive to said signal to provide an output for selectively controlling the energization of said coils.

* * * * *

US004387685B1

REEXAMINATION CERTIFICATE (3432nd)

United States Patent [19] [11] B1 4,387,685

Abbey [45] Certificate Issued Feb. 3, 1998

[54] FLUIDIC CONTROL SYSTEM INCLUDING VARIABLE VENTURI

[76] Inventor: Harold G. Abbey, 11 Goldsmith Dr., Holmdel, N.J. 07733

Reexamination Request:
No. 90/003,310, Jan. 12, 1994

Reexamination Certificate for:

| | |
|---|---|
| Patent No.: | **4,387,685** |
| Issued: | **Jun. 14, 1983** |
| Appl. No.: | **307,956** |
| Filed: | **Oct. 2, 1981** |

Related U.S. Application Data

[63] Continuation-in-part of Ser. No. 214,626, Dec. 10, 1980, Pat. No. 4,308,835, which is a continuation-in-part of Ser. No. 115,551, Jan. 25, 1980, Pat. No. 4,250,856, which is a continuation-in-part of Ser. No. 962,883, Nov. 22, 1978, Pat. No. 4,187,805, which is a continuation-in-part of Ser. No. 919,541, Jan. 27, 1978, abandoned, which is a division of Ser. No. 730,956, Oct. 9, 1976, Pat. No. 4,118,444.

[51] Int. Cl.[6] ..... F02M 9/14

[52] U.S. Cl. ..... 123/439; 73/861.53; 73/861.63; 123/702; 138/45; 138/46; 261/23.2; 261/44.5; 261/53; 261/DIG. 56

[58] Field of Search ..... 138/45

[56] References Cited

U.S. PATENT DOCUMENTS

| | | | |
|---|---|---|---|
| 1,013,762 | 1/1912 | Gibbs | 92/135 |
| 1,200,315 | 10/1916 | Coulombe | 261/48 |
| 1,612,320 | 12/1926 | Schroeder | 261/44.5 |
| 1,644,029 | 10/1927 | Porsche | 261/44.5 |
| 2,703,959 | 3/1955 | Wetherbee, Jr. | 138/45 |
| 2,785,669 | 3/1957 | Armstrong | 123/462 |
| 3,339,900 | 9/1967 | De Rugeris | 261/50 |
| 3,628,515 | 12/1971 | Knapp et al. | 123/455 |
| 4,118,444 | 10/1978 | Abbey | 261/44 A |
| 4,170,975 | 10/1979 | Wessel et al. | 123/455 |
| 4,187,805 | 2/1980 | Abbey | 123/439 |
| 4,263,235 | 4/1981 | Holzbaur et al. | 261/89 |

FOREIGN PATENT DOCUMENTS

| | | |
|---|---|---|
| 673 510 | 3/1939 | Germany . |
| 26 10 193 | 9/1977 | Germany . |

OTHER PUBLICATIONS

Niepoth et al., *IEEE Spectrum*, 52–55 (Nov. 1977).

*Primary Examiner*—Andrew M. Dolinar

[57] ABSTRACT

A fluidic control system provided with a variable Venturi structure whose movable element is automatically shifted as a function of the mass-volume of fluids passing through the structure to produce an output which depends on the adjusted position of the element or the resultant velocity-pressure. The system is applicable to the metering, proportioning and blending of fluids. In the context of an internal combustion automotive engine in which the variable Venturi structure acts to intermingle combustion air and fuel prior to ignition, the system provides a stoichiometric or other ratio of air-to-fuel that represents the optimum value for the prevailing condition of engine speed and load throughout a broad operating range, thereby effecting a marked improvement in fuel economy and reducing the emission of pollutants.

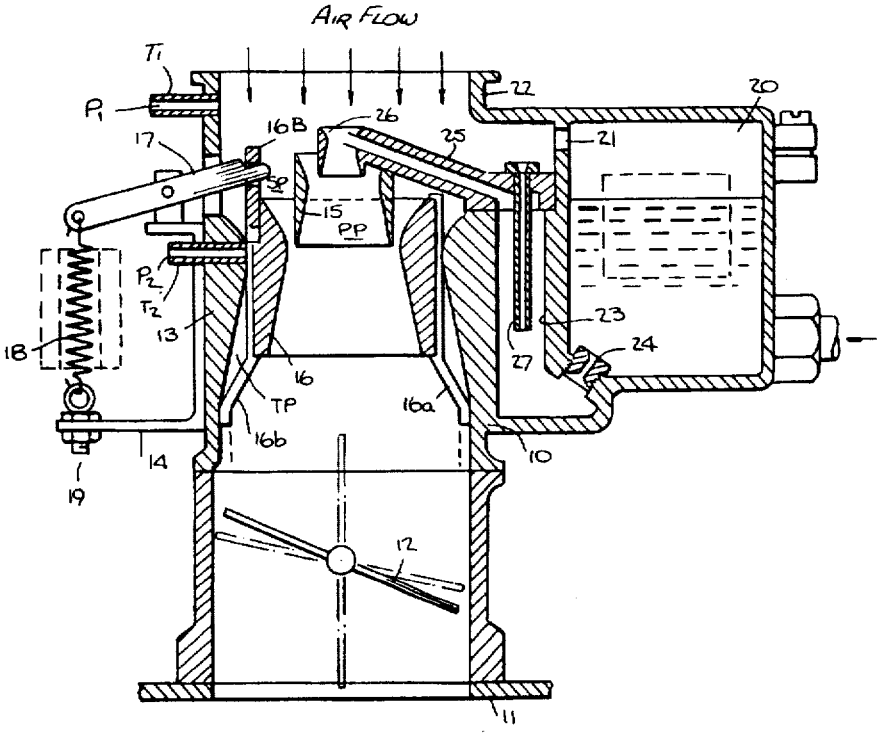

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 6–14:

This application is a continuation-in-part of my co-pending application Ser. No. 214,626, filed Dec. 10, 1980, (now U.S. Pat. No. 4,308,835) entitled "Closed-Loop Fluidic Control System for Internal Combustion Engine," which in turn is [related to earlier-filed applications identified therein] *a continuation-in-part of application Ser. No. 115,551, filed Jan. 25, 1980, now U.S. Pat. No. 4,250,856, which is a continuation-in-part of application Ser. No. 962,883, filed Nov. 22, 1978, now U.S. Pat. No. 4,187,805, which is a continuation-in-part of application Ser. No. 919,541, filed Jan. 27, 1978, now abandoned, which is a division of application Ser. No. 730,956, filed Oct. 9, 1976, now U.S. Pat. No. 4,118,444*, the entire disclosure of [my co-pending application and of the] *these* earlier-filed related applications being incorporated herein by reference.

AS A RESULT OF REEXAMINATION, IT HAS BEEN DETERMINED THAT:

Claims 1–15 are determined to be patentable as amended.

1. A *fluidic system provided with* variable *venturi* structure [which provides throughout an extended range the characteristics of a Venturi whose differential velocity-pressure output is proportional to] *for measuring* the mass-volume of a fluid stream passing [therethrough], *through the structure*, said structure comprising:

A a tubular *section of* casing *having an internal parabolic contoured venturi surface of circular cross section* into which the fluid stream is admitted;

B a cylindrical spool supported within the *tubular section of* casing for free axial movement therein, said spool having an interior *central parabolic venturi* flow passage *extending to a downstream end of said spool*, said spool defining an exterior *venturi* flow passage in the annular space between *the exterior surface of* the spool and the *tubular section of* casing which exterior *annular* passage is always open in the course of said movement whereby the *fluid* stream admitted into the *tubular section of* casing is divided and flows through the interior and exterior passages, said spool having [a Venturi-contoured surface lying in] at least [one of] said *exterior annular venturi flow* passage[s], causing said *fluid* stream to exert a hydrodynamic force on the spool whics acts to displace the spool axially in the downstream direction; [and]

C means imposing a countervailing force on the spool whereby the extent of spool displacement is the resultant of the hydrodynamic and countervailing forces, said displacement providing a differential velocity-pressure output proportional to the mass volume of the admitted fluid stream throughout an extended range; *and*

*D means for providing a measurement of the mass volume of the admitted fluid according to spool displacement.*

2. A [structure] *system* as set forth in claim 1, wherein said [inner wall] *venturi surface* of said *section of* casing has a [Venturi form whose] throat [is] provided with a pressure tap, said *section of* casing having an inlet tap whereby a pressure differential is developed between said taps when fluid passes through said *venturi* structure.

3. A [structure] *system* as set forth in claim 2, further including a differential-pressure transducer coupled to said pressure taps to provide a signal dependent on the mass-volume of fluid passing through the *venturi* structure.

4. A [structure] *system* as set forth in claim 1, wherein said countervailing force is provided by a spring operatively coupled to the spool.

5. A [structure] *system* as set forth in claim 4, wherein said spring is mounted outside the *section of* casing and is linked by a crank arm extending through a slot in the *section of* casing to the spool, said slot determining the limits of spool movement.

6. A [structure] *system* as set forth in claim 5, further including an external displacement transducer operatively coupled to said spool to provide a signal depending on the mass-volume of fluid passing through the *venturi* structure.

7. A [structure] *system* as set forth in claim 6, further including means to govern the metering of another fluid in proportion to the displacement signal representing the mass-volume of the fluid flowing through the *venturi* structure.

8. A [structure] *system* as set forth in claim 7, for regulating the ratio of fuel to throttle-controlled combustion air to produce an ignitable mixture for the intake manifold of an internal combustion automotive engine, said combustion air being fed into the inlet of said *section of* casing, said fuel intermingled with air being fed into a fixed booster coaxially disposed with respect to said spool whereby the axial displacement of said spool in response to the resultant hydrodynamic forces provides a ratio of air-to-fuel that is optimum for prevailing conditions of engine speed and load throughout the range of engine operating conditions.

9. A [Venturi structure] *system* as set forth in claim 8, wherein said fuel is fed into said booster through a nozzle Venturi.

10. A [Venturi structure] *system* as set forth in claim 8, in combination with means to feed pressurized fuel therein and a vacuum amplifier coupled to the intake manifold and responsive to [the] *an* existing pressure differential between [said] *two pressure* taps to derive from the prevailing vacuum in the manifold an amplified output signal which is a function of said pressure differential, and means responsive to said signal to vary the feed of fuel into [the] *a* carburetor *having said venturi structure*.

11. A [plurality of Venturi structures, each] *system* as set forth in claim 8, *including a plurality of said venturi structures* in a multi-barrelled arrangement in which the spools are linked to a common biasing spring and the throttles are ganged.

12. A [plurality of Venturi structures each] *system* as set forth in claim 8, *including a plurality of said venturi structures* in a multi-barrel arrangement in which the spools are individually spring-biased and the throttles are differentially linked to effect sequential opening and closing thereof.

13. A [Venturi structure] *system* as set forth in claim 8, further including means to vary the tension imposed by the spring.

14. A [Venturi structure] *system* as set forth in claim 13, wherein said spring is provided with a magnetizable element which operates in conjunction with upper and lower coils, which coils, when selectively energized, attract the element in a direction causing a reduction or increase in spring tension.

15. A [structure] *system* as set forth in claim 14, further including means to sense the air-fuel ratio in the exhaust of the engine and to produce a signal representative thereof, and a microprocessor responsive to said signal to provide an output for selectively controlling the energization of said coils.

* * * * *